US012078346B2

(12) United States Patent
Go et al.

(10) Patent No.: US 12,078,346 B2
(45) Date of Patent: Sep. 3, 2024

(54) HOLLOW NOZZLE, COMBUSTOR INCLUDING HOLLOW NOZZLE, AND GAS TURBINE INCLUDING COMBUSTOR

(71) Applicant: DOOSAN ENERBILITY CO., LTD, Changwon-si (KR)

(72) Inventors: Young Gun Go, Yongin-si (KR); Sang Pil Jo, Seo-gu (KR); Kyoung Taek Oh, Hwaseong-si (KR)

(73) Assignee: DOOSAN ENERBILITY CO., LTD., Changwon-si (KR)

( * ) Notice: Subject to any disclaimer, the term of this patent is extended or adjusted under 35 U.S.C. 154(b) by 0 days.

(21) Appl. No.: 18/216,397

(22) Filed: Jun. 29, 2023

(65) Prior Publication Data

US 2024/0003538 A1 Jan. 4, 2024

(30) Foreign Application Priority Data

Jun. 29, 2022 (KR) ..... 10-2022-0079727

(51) Int. Cl.
*F23D 14/58* (2006.01)
*F23D 14/02* (2006.01)
(Continued)

(52) U.S. Cl.
CPC ..... *F23D 14/58* (2013.01); *F23D 14/02* (2013.01); *F23D 14/64* (2013.01); *F23R 3/14* (2013.01); *F23R 3/286* (2013.01)

(58) Field of Classification Search
CPC ..... F23D 11/408; F23D 14/02; F23D 14/58; F23D 14/64; F23R 3/14; F23R 3/286; F23R 3/425; F23R 3/44; F23R 3/46; F23R 3/50; F23R 3/52; F23R 3/54; F23R 3/58; F23R 2900/03282; F23R 2900/03341; F23R 2900/03342; F23R 2900/03343
See application file for complete search history.

(56) References Cited

U.S. PATENT DOCUMENTS

2008/0078183 A1 4/2008 Ziminsky et al.
2019/0086090 A1 3/2019 Dolmansley et al.

FOREIGN PATENT DOCUMENTS

CN 204438189 U 7/2015
EP 2161502 A1 * 3/2010 ..... F23C 7/004
(Continued)

OTHER PUBLICATIONS

English translation of WO2016093429 (Year: 2016).*
English translation of EP2161502 (Year: 2010).*

*Primary Examiner* — Scott J Walthour
(74) *Attorney, Agent, or Firm* — Shook, Hardy & Bacon L.L.P.

(57) ABSTRACT

A hollow nozzle including a tubular nozzle casing and a plurality of rotary vanes arranged radially along an inner surface of an inlet of the nozzle casing, through which compressed air is introduced, forming a hollow center at the center of the nozzle casing through which the compressed air flows, each of the rotary vanes including a first fuel injection hole through which a first type of fuel having a predetermined flame propagation speed is injected toward the hollow center, and a second fuel injection hole through which a second type of fuel having a higher flame propagation speed than the first type of fuel is injected, a combustor including the hollow nozzle, and a gas turbine including the combustor.

13 Claims, 6 Drawing Sheets

(51) Int. Cl.

| | |
|---|---|
| ***F23D 14/64*** | (2006.01) |
| ***F23R 3/14*** | (2006.01) |
| ***F23R 3/28*** | (2006.01) |

(56) References Cited

FOREIGN PATENT DOCUMENTS

| | | | | |
|---|---|---|---|---|
| KR | 10-2164622 | B1 | 10/2020 | |
| WO | WO-2016093429 | A1 * | 6/2016 | ..... F02C 7/22 |

* cited by examiner

HOLLOW NOZZLE, COMBUSTOR INCLUDING HOLLOW NOZZLE, AND GAS TURBINE INCLUDING COMBUSTOR

CROSS REFERENCE TO RELATED APPLICATION

The present application claims priority to Korean Patent Application No. 10-2022-0079727, filed on Jun. 29, 2022, the entire contents of which are incorporated herein for all purposes by this reference.

BACKGROUND OF THE INVENTION

1. Field of the Invention

The present disclosure relates to a hollow nozzle, a combustor including the hollow nozzle, and a gas turbine including the combustor and, more particularly, to a hollow nozzle in which compressed air supplied from a compressor is mixed with fuel, an air-fuel mixture is combusted, and the resulting combustion gases are supplied to a turbine, a combustor including the hollow nozzle, and a gas turbine including the combustor.

2. Description of the Background Art

In general, a turbomachine refers to an apparatus that generates power for power generation through a fluid (particularly, gas) passing through the turbomachine. Therefore, the turbomachine is usually installed and used together with a generator. Such a turbomachine may include a gas turbine, a steam turbine, a wind power turbine, and the like. The gas turbine is an apparatus that mixes compressed air and natural gas and combusts an air-fuel mixture to generate combustion, which in turn generates power for power generation. The steam turbine is an apparatus that heats water to generate steam, which in turn generates power for power generation. The wind turbine is an apparatus that converts wind power into power for power generation.

Among the turbomachines, the gas turbine includes a compressor, a combustor, and a turbine. The compressor has a plurality of compressor vanes and compressor blades alternately arranged within a compressor casing. In addition, the compressor sucks external air through a compressor inlet scroll strut. The sucked air is compressed by the compressor vanes and the compressor blades while passing through an interior of the compressor. The combustor receives the compressed air from the compressor and mixes the compressed air with fuel to form a fuel-air mixture.

In addition, the combustor ignites the fuel-air mixture with an igniter to generate high-temperature and high-pressure combustion gas. The generated combustion gas is supplied to the turbine. In the turbine, a plurality of turbine vanes and turbine blades are arranged in a turbine casing. The combustion gas generated by the combustor passes through the turbine. While passing through an interior of the turbine, the combustion gas rotates the turbine blades and then is discharged to the outside through a turbine diffuser.

Among the turbomachines, the steam turbine includes an evaporator and a turbine. The evaporator heats water supplied from the outside to generate steam. In the turbine, a plurality of turbine vanes and turbine blades are alternately disposed in a turbine casing, similarly to the turbine in a gas turbine. However, in the turbine in the steam turbine, the steam generated in the evaporator, instead of the combustion gas, passes through the turbine to rotate the turbine blades.

On the other hand, among turbomachines, in the case of a gas turbine, a high temperature flame is generated inside the combustor, so it is necessary to protect a fuel nozzle that injects a mixture of fuel and air into a combustion chamber of the combustor from such a high temperature flame.

When two types of fuels with different flame propagation speeds are used simultaneously in a turbomachine, the flame position is not uniformly guided due to the difference in flame propagation speeds, and noise and vibration are generated during the combustion process due to incomplete combustion.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a hollow nozzle capable of simultaneously using both a fuel with a relatively high flame propagation speed and a fuel with a relatively low flame propagation speed and supplying the two types of fuels in a uniformly mixed state, a combustor including the hollow nozzle, and a gas turbine including the combustor.

According to an aspect of the present disclosure, there is provided a hollow nozzle configured to mix compressed air supplied from a compressor of a gas turbine with fuel supplied from a fuel supply and supply a compressed air-fuel mixture into a liner, the hollow nozzle including: a tubular nozzle casing; and a plurality of rotary vanes arranged radially along an inner surface of an inlet of the nozzle casing, through which compressed air is introduced, forming a hollow center at the center of the nozzle casing through which the compressed air flows, each of the rotary vanes including: a first fuel injection hole through which a first type of fuel having a predetermined flame propagation speed is injected toward the hollow center; and a second fuel injection hole through which a second type of fuel having a higher flame propagation speed than the first type of fuel is injected.

The first fuel injection hole may be formed on a side facing the center of the nozzle casing of the rotary vane.

The first fuel injection hole may be provided in plural such that a plurality of first injection holes is arranged at regular intervals along a longitudinal direction of the side facing the center of the nozzle casing.

The second fuel injector may be formed in a side facing the inlet of the nozzle casing of the rotary vane, wherein the second type of fuel flows along an outer surface of the rotary vane.

The second fuel injection hole may be provided in plural such that a plurality of second injection holes is arranged at regular intervals along a side facing the inlet of the nozzle casing.

According to another aspect of the present disclosure, there is provided a combustor configured to mix compressed air supplied from a compressor with fuel, combust a mixed fluid, and supply combustion gases to a turbine section, the combustor including: a hollow nozzle configured to receive and mix the compressed air from the compressor and the fuel through a fuel supply to produce the mixed fluid; a liner connected to the hollow nozzle and forming a combustion chamber in which the mixed fluid produced in the hollow nozzle is combusted; and a transition piece connected to the liner to supply the combustion gases produced in the liner to the turbine section, the hollow nozzle including: a tubular nozzle casing; and a plurality of rotary vanes arranged radially along an inner surface of an inlet of the nozzle casing, through which the compressed air is introduced, forming a hollow center at the center of the nozzle casing through which the compressed air flows, each of the rotary vanes including: a first fuel injection hole through which a first type of fuel having a predetermined flame propagation speed is injected toward the hollow center; and a second fuel injection hole through which a second type of fuel having a higher flame propagation speed than the first type of fuel is injected.

According to a further aspect of the present disclosure, there is provided a gas turbine including: a compressor configured to compress air supplied from the outside; a turbine section configured to generate power for generating electricity as combustion gases internally pass through the turbine section; and a combustor configured to mix the compressed air supplied from the compressor with fuel, combust a mixed fluid, and supply combustion gases to the turbine section, the combustor including: a hollow nozzle configured to receive and mix the compressed air from the compressor and the fuel through a fuel supply to produce the mixed fluid; a liner connected to the hollow nozzle and forming a combustion chamber in which the mixed fluid produced in the hollow nozzle is combusted; and a transition piece connected to the liner to supply the combustion gases produced in the liner to the turbine section, the hollow nozzle including: a tubular nozzle casing; and a plurality of rotary vanes arranged radially along an inner surface of an inlet of the nozzle casing, through which the compressed air is introduced, forming a hollow center at the center of the nozzle casing through which the compressed air flows, each of the rotary vanes including: a first fuel injection hole through which a first type of fuel having a predetermined flame propagation speed is injected toward the hollow center; and a second fuel injection hole through which a second type of fuel having a higher flame propagation speed than the first type of fuel is injected.

The effects produced by the hollow nozzle, the combustor including the hollow nozzle, and the gas turbine including the combustor according to the present disclosure are as follows.

The present disclosure has the effect that a fuel with a relatively high flame propagation speed and a fuel with a relatively low flame propagation speed can both be used at the same time, and can be supplied in a uniformly mixed state.

BRIEF DESCRIPTION OF THE DRAWINGS

The above and other aspects will become more apparent from the following description of the exemplary embodiments with reference to the accompanying drawings, in which.

DETAILED DESCRIPTION OF THE INVENTION

Figure 1:
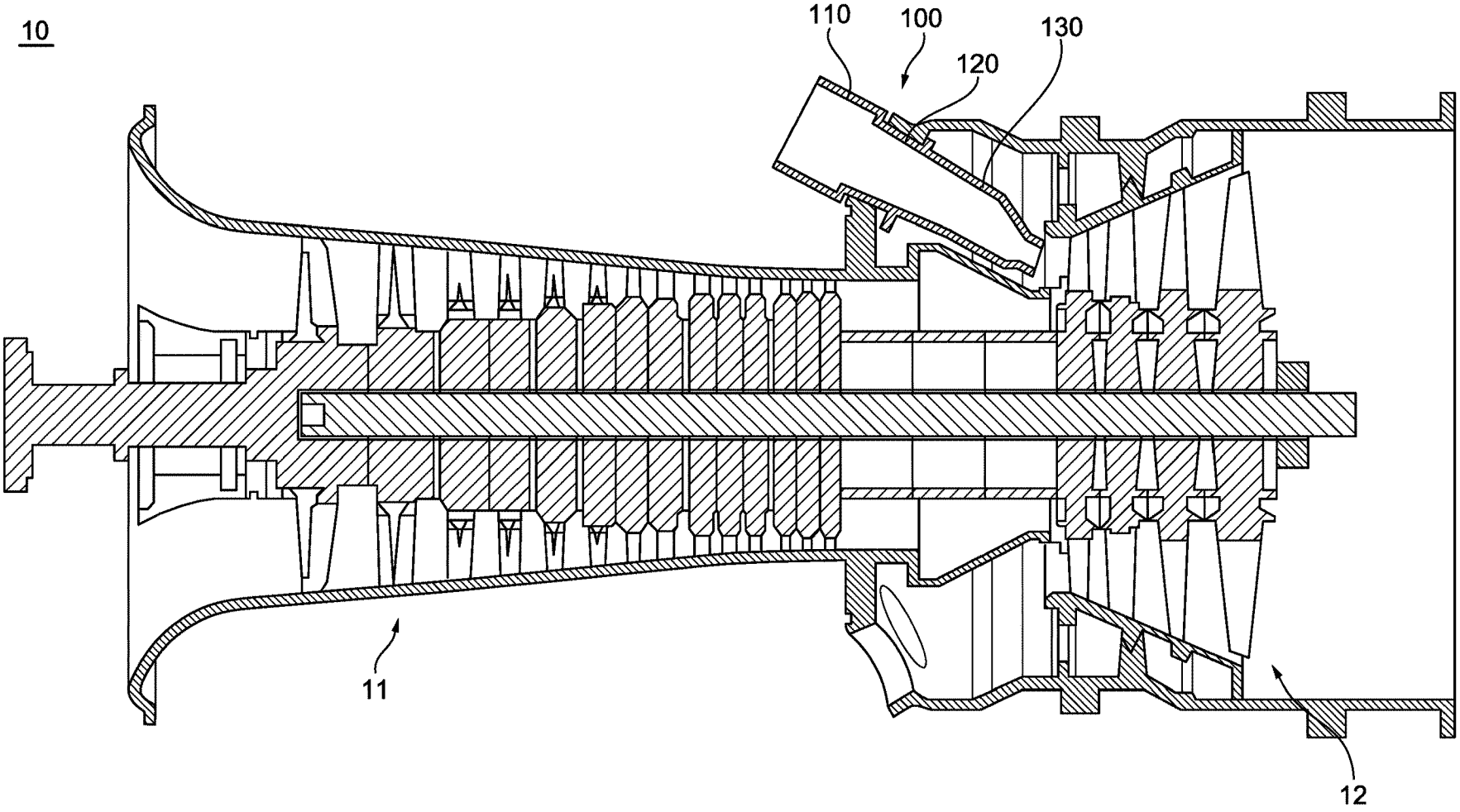
FIG. 1 is a cross-sectional view illustrating a gas turbine according to the present disclosure.
Figure 2:
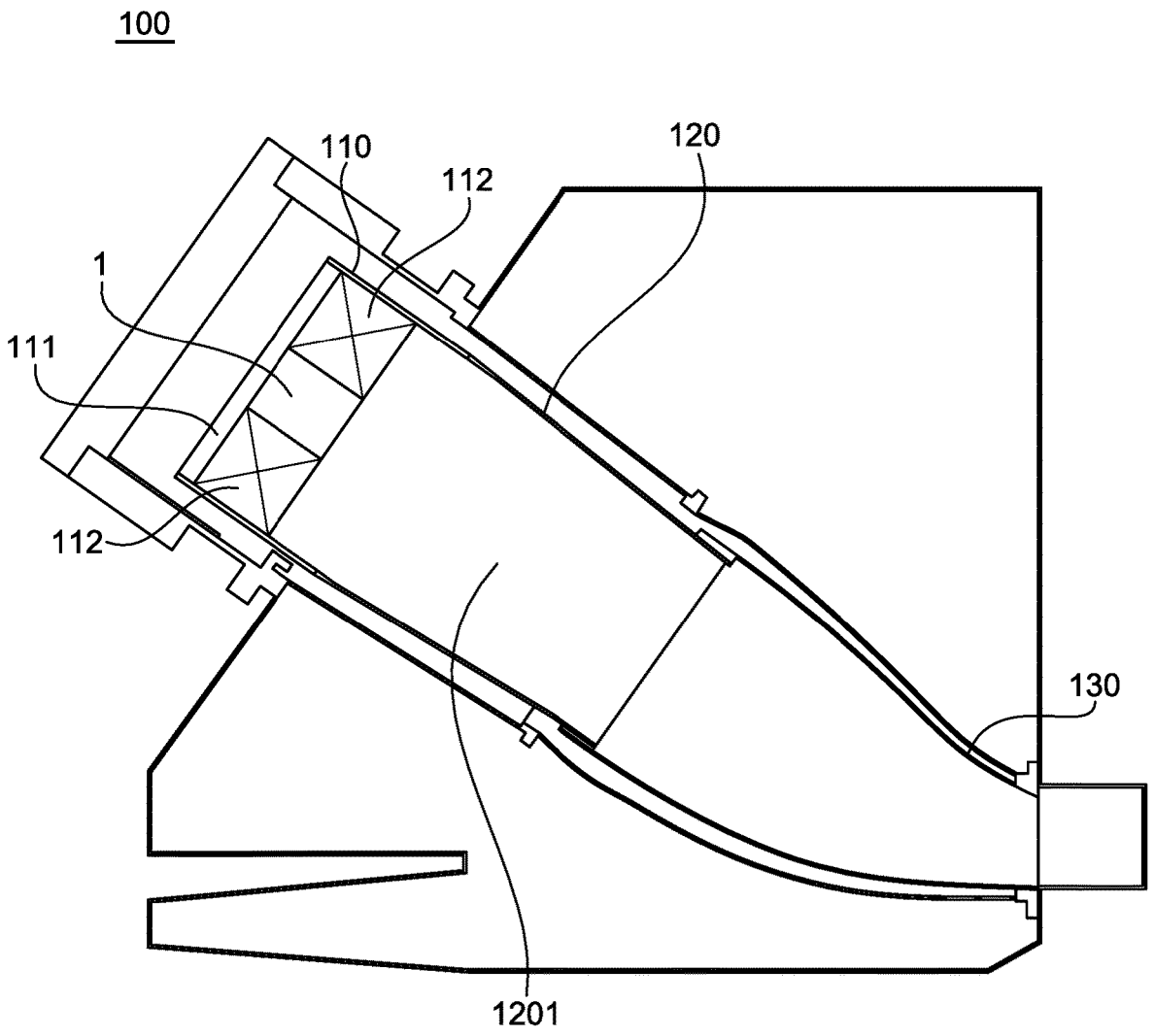
FIG. 2 is a schematic view illustrating a combustor illustrated in FIG. 1.
Figure 3:
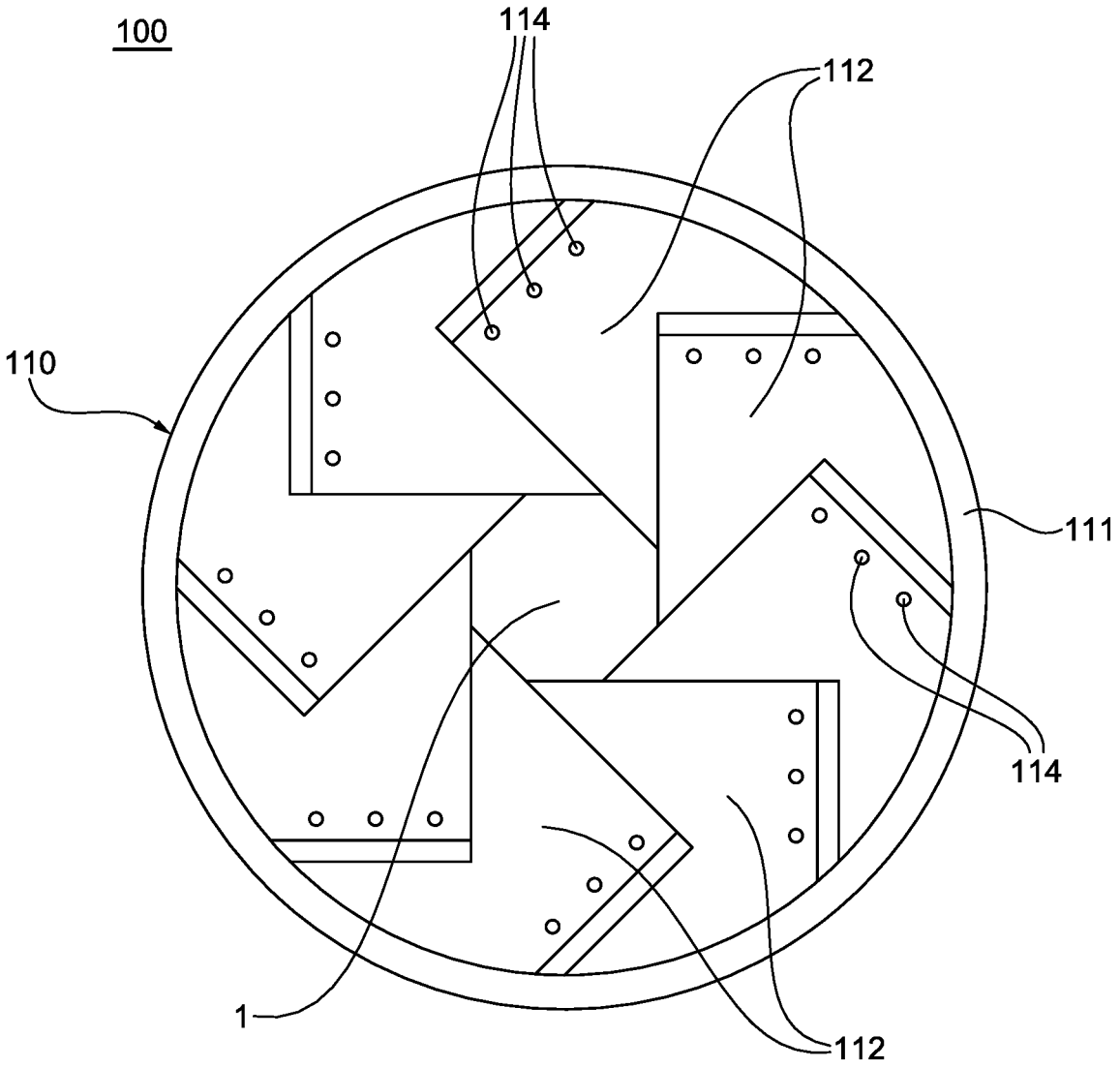
FIG. 3 is an exemplary view illustrating a hollow nozzle inlet of a gas turbine combustor according to an embodiment of the present disclosure.
Figure 4:
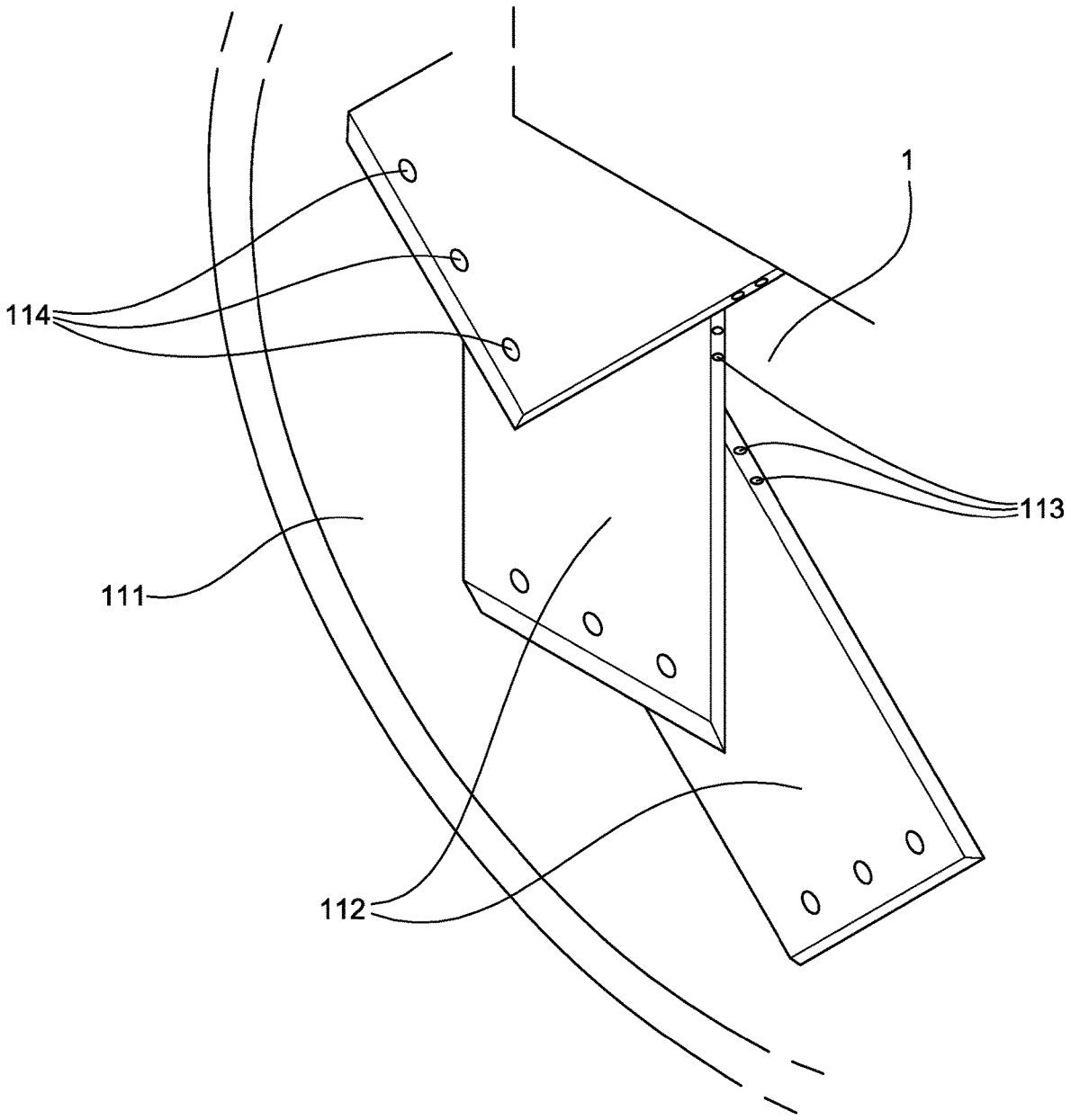
FIG. 4 is an illustrative view illustrating a hollow nozzle outlet of a gas turbine combustor according to an embodiment of the present disclosure.
Figure 5:
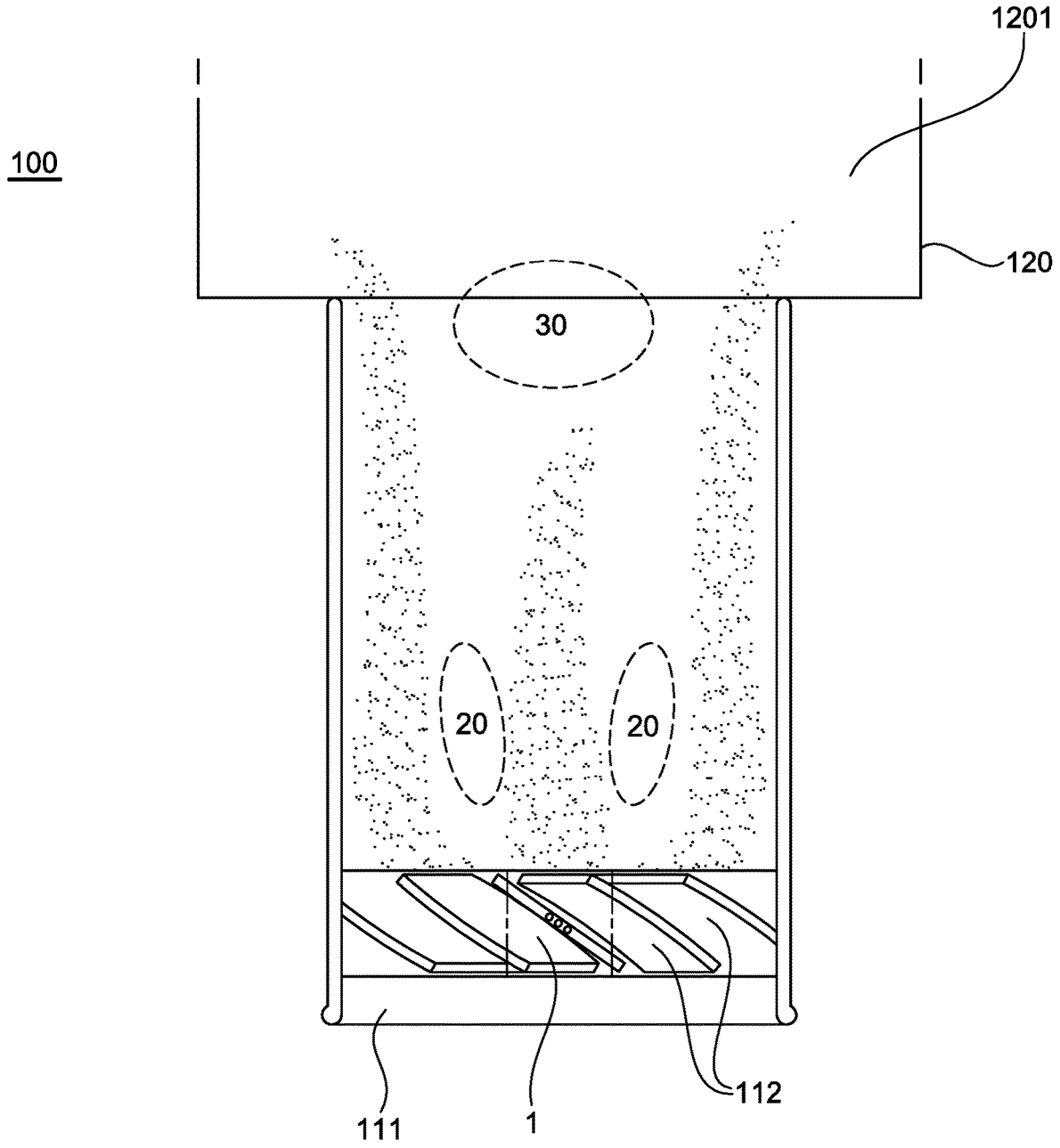
FIG. 5 is an illustrative view illustrating a flame state according to a hollow nozzle of a gas turbine combustor according to an embodiment of the present disclosure.
Figure 6:
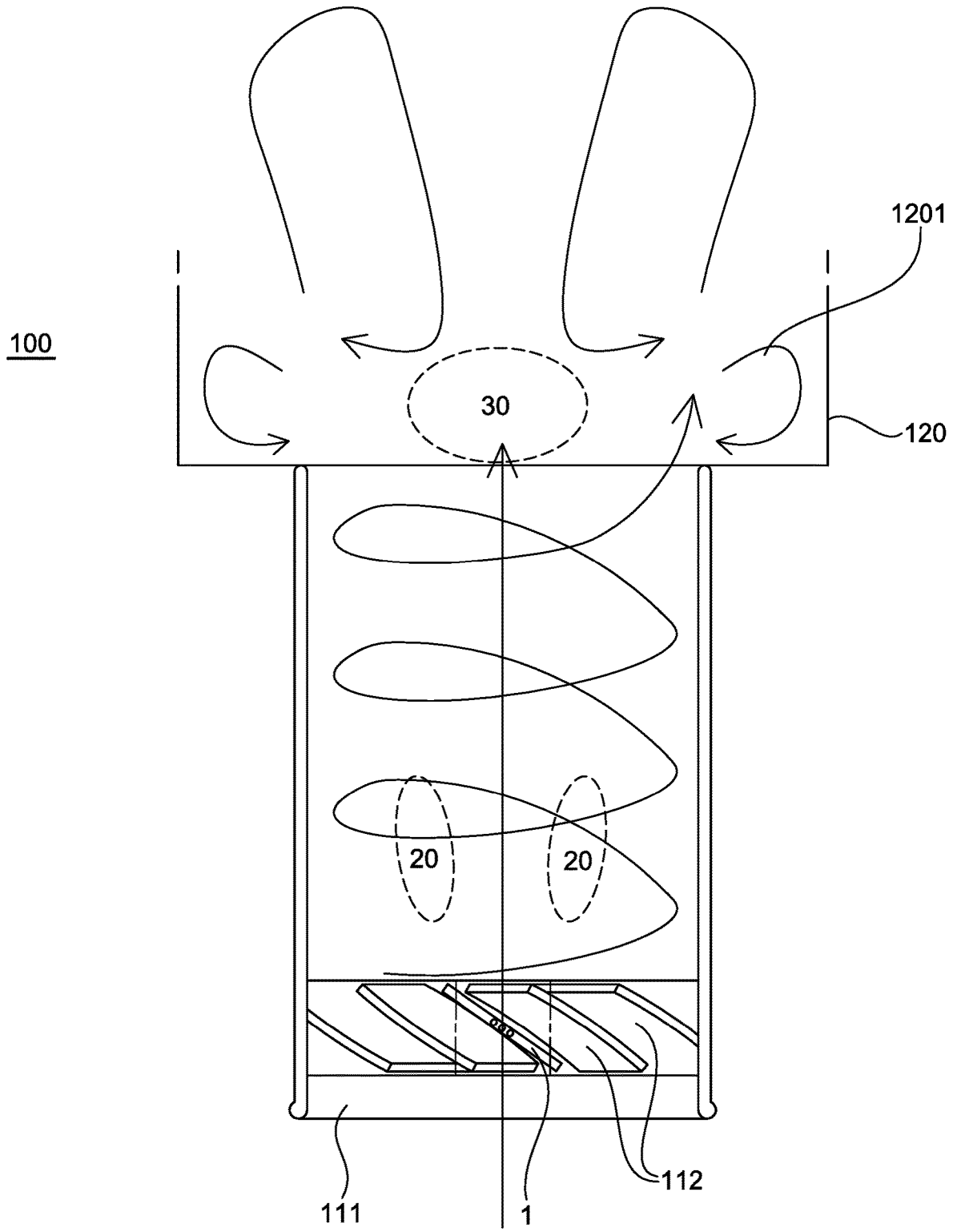
FIG. 6 is an illustrative view illustrating flows of fuel and compressed air through the hollow nozzle of the gas turbine combustor according to an embodiment of the present disclosure.

Hereinafter, preferred embodiments according to the present disclosure will be described in detail with reference to the accompanying drawings. Prior to describing the present disclosure, the terms or words used herein should not be construed as being limited to conventional or dictionary meanings, but may only construed as meanings and concepts consistent with the technical idea of the present disclosure on the basis of the principle that the inventors can properly define the meanings and concepts of the terms in order to best describe his invention.

Accordingly, embodiments described herein and the configurations illustrated in the drawings are only the most preferred embodiments of the present disclosure and do not represent the entire technical idea of the invention, so it is to be understood that there may be equivalent variations that can be substituted for the embodiments and the configurations.

The present disclosure is directed to a hollow nozzle, which is capable of simultaneously utilizing two types of fuels with different flame propagation speeds, a combustor including the hollow nozzle, and a gas turbine including the combustor, which will be described with reference to the drawings.

Referring to FIG. 1, a gas turbine 10 includes a compressor 11, a combustor 100, and a turbine section 12. In a flow direction of gas (compressed air or combustion gas), the compressor 11 is disposed on the upstream side of the gas turbine 10, and the turbine section 12 is disposed on the downstream side of the gas turbine. In addition, the combustor 100 is arranged between the compressor 11 and the turbine section 12.

The compressor 11 accommodates, inside a compressor casing, compressor vanes and a compressor rotor including a compressor disk and compressor blades, and the turbine section 12 accommodates, inside a turbine casing, turbine vanes and a turbine rotor including a turbine disk and turbine blades. These compressor vanes and the compressor rotor are arranged in a multi-stage along a flow direction of compressed air, and the turbine vanes and the turbine rotor are also arranged in a multi-stage along a flow direction of combustion gas.

At this time, it is designed such that the compressor 11 has an internal space of which the volume decreases from the front-stage toward the rear-stage so that the intake air can be compressed, whereas the turbine 12 has an internal space of which the volume increases from the front-stage toward the rear-stage so that the combustion gas supplied from the combustor can expand.

On the other hand, between the compressor rotor located on the rear end side of the compressor 11 and the turbine rotor located on the front end side of the turbine section 12, a torque tube is disposed as a torque transmission member to transmit the rotational torque generated by the turbine section 12 to the compressor 11. Although the torque tube may be composed of a plurality of torque tube disks arranged in three stages in total as illustrated in FIG. 1, this is only one of several embodiments of the present disclosure, so the torque tube may be composed of a plurality of torque tube disks arranged in four or more stages or two or less stages.

The compressor rotor includes a compressor disk and a compressor blade. A plurality of (e.g., 14) compressor disks are provided inside the compressor casing, and the respective compressor disks are fastened so as not to be spaced apart in the axial direction by a tie rod.

More specifically, the respective compressor disks are aligned along the axial direction with the tie rod passing through the central portion thereof, and adjacent compressor disks are arranged such that the opposing surfaces of the adjacent compressor disks are compressed by the tie rod so that the adjacent compressor disks cannot rotate relative to each other.

The plurality of compressor blades is radially coupled to an outer circumferential surface of the compressor disk in a multi-stage. Further, the plurality of compressor vanes is arranged in a multi-stage on an inner circumferential surface of the compressor casing such that each stage of compressor vanes is disposed between adjacent stages of compressor blades. Unlike the compressor disk, the compressor vanes maintain a fixed state so as not to rotate, and serve to guide the compressed air, which passed through an upstream-side stage of compressor blades, to a downstream-side stage of compressor blades. Here, the compressor casing and the compressor vanes may be collectively defined as a compressor stator to distinguish them from the compressor rotor.

The tie rod is arranged to penetrate the center of the plurality of compressor disks and turbine disks, which will be described later, such that one end thereof is fastened in the compressor disk located on the foremost end side of the compressor and the other end thereof is fastened by a fastening nut.

Since the tie rod may be formed in various structures depending on the gas turbine, the shape of the tie rod is not necessarily limited to the shape illustrated in FIG. 1. That is, as illustrated, one tie rod may have a form in which the tie rod passes through the central portion of the compressor disks and the turbine disks, a form in which the plurality of tie rods are arranged in a circumferential manner, or a combination thereof.

Although not illustrated in the drawings, the compressor of the gas turbine may be provided with a deswirler that serves as a guide for increasing a pressure of fluid and adjusting a flow angle of the fluid entering a combustor inlet to a designed flow angle.

The combustor 100 serves to mix an incoming compressed air with fuel and combust the air-fuel mixture to produce high-temperature, high-pressure combustion gas with high energy, thereby raising the temperature of the combustion gas up to the heat-resistant limit of the combustor and turbine parts through an isothermal combustion process.

The plurality of combustors 100 may be arranged in combustor casing having a cell shape to constitute a combustion system of the gas turbine 10, wherein each of the combustors includes a fuel nozzle 110 through which fuel is injected, a liner 120 forming a combustion chamber, a transition piece 130 formed as a connection between the combustor 100 and the turbine section 12.

Specifically, the liner 120 provides a combustion space in which fuel injected through the fuel nozzle 110 and compressed air supplied from the compressor 11 are mixed and burned. The liner 120 includes a combustion chamber that provides the combustion space in which the fuel mixed with air is burned, and an annular flow path that forms an annular space while surrounding the combustion chamber.

In addition, the fuel nozzle 110 is coupled to the front side of the liner 120 and an igniter is coupled to the sidewall of the liner 120.

In the liner annular flow path, compressed air introduced through a plurality of holes provided in an outer wall of the liner 120 flows, and the compressed air that cooled the transition piece 130 to be described later also flows. As such, as the compressed air flows along the outer wall of the liner 120, it is possible to prevent the liner 120 from being thermally damaged by heat generated by the combustion of fuel in the combustion chamber.

The transition piece 130 is connected to the rear side of the liner so that the combustion gas burned by an ignition plug can be transferred to the turbine side. Similar to the liner 120, the transition piece 130 has an annular flow path surrounding an inner space of the transition piece 130 is formed. As the compressed air flows along the annular flow path, the outer wall of the transition piece 130 is cooled to prevent damage due to high temperature of the combustion gas.

Meanwhile, the high-temperature and high-pressure combustion gas from the combustor 100 is supplied to the turbine section 12 described above. The high-temperature and high-pressure combustion gas supplied to the turbine section 12 expands while passing through the inside of the turbine section 12, and accordingly, impulses and reaction forces are applied to the turbine blades, which will be described later, to generate rotational torque. The resultant rotational torque is transmitted to the compressor through the above-described torque tube, and an excess of the power required to drive the compressor is used to drive a generator or the like.

The turbine section 12 is fundamentally similar to the structure of a compressor 11. That is, the turbine section 12 is also provided with a plurality of turbine rotors similar to the compressor rotor of the compressor 11. Thus, the turbine rotor includes a turbine disk and a plurality of turbine blades radially disposed around the turbine disk. The plurality of turbine vanes is also annually arranged, on the basis of the same stage, on the turbine casing between adjacent stages of turbine blades to guide a flow direction of the combustion gas, which passed through the turbine blades. Here, the turbine casing and the turbine vanes may be collectively defined as a turbine stator to distinguish them from the turbine rotor.

Referring to FIGS. 2 to 6, a gas turbine combustor 100 according to one embodiment of the present disclosure includes a hollow nozzle 110, a liner 120, and a transition piece 130.

First, the hollow nozzle 110 receives compressed air from the compressor 11 and fuel through a fuel supply (not shown), and produces a mixed fuel (air-fuel mixture).

The liner 120 is connected to the downstream side of the hollow nozzle 110 with respect to a flow direction of compressed air or combustion gases, and internally forms a combustion chamber 1201 in which the mixed fluid (air-fuel mixture) injected from the hollow nozzle 110 is burned.

The transition piece 130 is connected to the downstream side of the liner 120, and supplies combustion gases generated in the combustion chamber of the liner 120 to the turbine section 12.

In addition, the hollow nozzle 110 includes a nozzle casing 111 and a plurality of rotary vanes 112, wherein the nozzle casing 111 is preferably formed from a hollow tube having a corresponding diameter.

The plurality of rotary vanes 112 is arranged radially along an inner surface of an inlet of the nozzle casing 111 through which the compressed air is introduced, forming a hollow center 1 through which the compressed air flows at the center of the nozzle casing 111.

At this time, each of the plurality of rotary vanes 112 is formed to be inclined at a corresponding specified angle as a conventional rotary vane, so that the compressed air passing through the rotary vanes 112 flows while turning.

Thus, a portion of the compressed air introduced through the inlet of the nozzle casing 111 through the hollow center 1 formed in the center of the nozzle casing 111 immediately flows along the longitudinal direction of the nozzle casing 111, and a portion of the compressed air flows while turning along the longitudinal direction of the nozzle casing 111 due to the plurality of rotary vanes 112.

In addition, each of the plurality of rotary vanes 112 has a first fuel injection hole 113 (illustrated in FIG. 4) and a second fuel injection hole 114, wherein the first fuel injection hole 113 is formed on the side facing the center (hollow center: 1) of the nozzle casing 111 in the rotary vanes 112, and ejects a first type of fuel with a relatively low flame propagation speed.

In this case, the first type of fuel is preferably LNG or NG (i.e., liquefied natural gas or natural gas, respectively), and the first fuel injection hole 113 is provided preferably in plural in number such that a plurality of first injection holes is arranged at regular intervals along the longitudinal direction of the side facing the center of the nozzle casing 111.

Thus, when the first type of fuel and compressed air are mixed and burned, a second low-speed flow region 30 is generated at an outlet of the length of the nozzle casing 111 as the compressed air passing through the center (hollow center: 1) of the nozzle casing 111 flows, and a flame position can be fixed in the second low-speed flow region 30.

Furthermore, the second fuel injection hole 114 is formed at an end of the side facing the inlet of the nozzle casing 111 of the rotary vane 112 to eject a second type of fuel having a relatively high flame propagation speed.

In this case, the second fuel is preferably hydrogen, and the second fuel injection hole 114 is provided preferably in plural in number such that a plurality of second fuel injection holes is arranged at regular intervals along the longitudinal direction of the side end facing the inlet of the nozzle casing 111.

Thus, the second type of fuel with a relatively high flame propagation speed ejected through the second fuel injection holes 114, together with the compressed air, flows in the form of a vortex while turning along the inner surface of the nozzle casing 111 along the rotary vanes 112, and is guided from the inlet to the outlet of the nozzle casing 111.

Here, the second type of fuel having a relatively high flame propagation speed generates a first low-speed flow region 20 along the length of the nozzle casing 111, and the flame position can be fixed in the first low-speed flow region 20.

In addition, the first low-speed flow region 20 has a larger distribution than the second low-speed flow region 30 as the fuel flows in the form of a vortex in the first low-speed flow region.

Therefore, the hollow nozzle, the combustor including the hollow nozzle, and the gas turbine including the combustor according to one embodiment of the present disclosure are capable of simultaneously or selectively using a fuel with a relatively low flame propagation speed and a fuel with a relatively high flame propagation speed, as well as fixing the flame position at a corresponding position depending on the types of fuel, so that the two types of fuel can be stably burned.

Although the present disclosure has been described with reference to the embodiments illustrated in the drawings, the described embodiments are merely illustrative, so those skilled in the art will understand that various modifications and equivalents thereof can be made therefrom. Therefore, the true technical scope of the present disclosure should be determined by the technical spirit of the appended claims.

What is claimed is:

1. A hollow nozzle configured to mix compressed air supplied from a compressor of a gas turbine with fuel supplied from a fuel supply and supply a compressed air-fuel mixture into a liner, the hollow nozzle comprising:

a tubular nozzle casing comprising an inlet through which compressed air is introduced; and a plurality of rotary vanes arranged circumferentially around a cylindrical inner surface of the nozzle casing, forming a hollow center at the center of the tubular nozzle casing through which the compressed air flows, each of the rotary vanes extending from the cylindrical inner surface towards the hollow center and comprising:

a first end affixed to the cylindrical inner surface, a freestanding second end with a first side facing towards the hollow center and opposite the first end;

a second side extending between the first end and the second end;

a first fuel injection hole provided on the first side through which a first fuel having a predetermined flame propagation speed is injected toward the hollow center; and a second fuel injection hole provided on the second side through which a second fuel having a higher flame propagation speed than the first fuel is injected.

2. The hollow nozzle according to claim 1, wherein the first fuel injection hole is provided in plural such that a plurality of first injection holes is arranged at regular intervals along a longitudinal direction of the first side of the rotary vane.

3. The hollow nozzle according to claim 1, wherein the second side of the rotary vane faces the inlet of the tubular nozzle casing, wherein the second fuel flows along an outer surface of the rotary vane.

4. The hollow nozzle according to claim 3, wherein the second fuel injection hole is provided in plural such that a plurality of second injection holes is arranged at regular intervals along the second side of the rotary vane.

5. A combustor configured to mix compressed air supplied from a compressor with fuel, combust a mixed fluid, and supply combustion gases to a turbine section, the combustor comprising:

a hollow nozzle configured to receive and mix the compressed air from the compressor and the fuel through a fuel supply to produce the mixed fluid;

a liner connected to the hollow nozzle and forming a combustion chamber in which the mixed fluid produced in the hollow nozzle is combusted; and a transition piece connected to the liner to supply the combustion gases produced in the liner to the turbine section, the hollow nozzle comprising:

a tubular nozzle casing comprising a tubular wall extending in an axial direction and an inlet through which compressed air is introduced;

the tubular wall having an inner surface; and a plurality of rotary vanes extending from the inner surface of the tubular wall in a direction transverse to the axial direction, each of the plurality of rotary vanes comprising a free first end, the first ends forming a hollow center at the center of the tubular nozzle casing through which the compressed air flows, each of the rotary vanes further comprising:

a first fuel injection hole through which a first fuel having a predetermined flame propagation speed is injected toward the hollow center; and a second fuel injection hole through which a second fuel having a higher flame propagation speed than the first fuel is injected.

6. The combustor according to claim 5, wherein the first fuel injection hole is provided on a side of the first end of the rotary vane facing the center of the tubular nozzle casing.

7. The combustor according to claim 6, wherein the first fuel injection hole is provided in plural such that a plurality of first injection holes is arranged at regular intervals along a longitudinal direction of the side of the rotary vane facing the center of the tubular nozzle casing.

8. The combustor according to claim 5, wherein the second fuel injection hole is provided in a side of the rotary vane extending from the free first end to the inner surface of the tubular wall and facing the inlet of the tubular nozzle casing, wherein the second fuel flows along an outer surface of the side of the rotary vane.

9. The combustor according to claim 8, wherein the second fuel injection hole is provided in plural such that a plurality of second injection holes is arranged at regular intervals along the side of the rotary vane facing the inlet of the tubular nozzle casing.

10. A gas turbine comprising:

a compressor configured to compress air supplied from outside the gas turbine;

a turbine section configured to generate power for generating electricity as combustion gases internally pass through the turbine section; and a combustor configured to mix the compressed air supplied from the compressor with fuel, combust a mixed fluid, and supply combustion gases to the turbine section, the combustor comprising:

a hollow nozzle configured to receive and mix the compressed air from the compressor and the fuel through a fuel supply to produce the mixed fluid;

a liner connected to the hollow nozzle and forming a combustion chamber in which the mixed fluid produced in the hollow nozzle is combusted; and a transition piece connected to the liner to supply the combustion gases produced in the liner to the turbine section, the hollow nozzle comprising:

a tubular nozzle casing comprising an inlet through which compressed air is introduced; and a plurality of rotary vanes arranged circumferentially around a cylindrical inner surface of the nozzle casing, forming a hollow center at the center of the tubular nozzle casing through which the compressed air flows, each of the rotary vanes extending from the cylindrical inner surface towards the hollow center and comprising:

a first end affixed to the cylindrical inner surface, a freestanding second end with a first side facing towards the hollow center and opposite the first end;

a second side extending between the first end and the second end;

a first fuel injection hole provided on the first side through which a first fuel having a predetermined flame propagation speed is injected toward the hollow center; and a second fuel injection hole provided on the second side through which a second fuel having a higher flame propagation speed than the first fuel is injected.

11. The gas turbine according to claim 10, wherein the first fuel injection hole is provided in plural such that a plurality of first injection holes is arranged at regular intervals along a longitudinal direction of the first side of the rotary vane.

12. The gas turbine according to claim 10, wherein the second side of the rotary vane faces the inlet of the tubular nozzle casing, wherein the second fuel flows along an outer surface of the rotary vane.

13. The gas turbine according to claim 12, wherein the second fuel injection hole is provided in plural such that a plurality of second injection holes is arranged at regular intervals along the second side of the rotary vane.

* * * * *